US005868072A

United States Patent [19]

Nishi

[11] Patent Number: 5,868,072

[45] Date of Patent: Feb. 9, 1999

[54] DEVICE FOR INSERTING AN EDGE OF A PLATE FOR A PRINTING MACHINE

[75] Inventor: Hidekazu Nishi, Fuchu, Japan

[73] Assignee: Ryobi Ltd., Hiroshima-ken, Japan

[21] Appl. No.: 995,212

[22] Filed: Dec. 19, 1997

[30] Foreign Application Priority Data

Jan. 13, 1997 [JP] Japan ..... 9-003856

[51] Int. Cl.[6] ..... B41F 27/12

[52] U.S. Cl. ..... 101/415.1; 101/477

[58] Field of Search ..... 101/409, 410, 101/415.1, 477

[56] References Cited

U.S. PATENT DOCUMENTS

| | | | |
|---|---|---|---|
| 5,211,112 | 5/1993 | Tsushima et al. | 101/415.1 |
| 5,560,298 | 10/1996 | Krokolinski et al. | 101/415.1 |
| 5,678,487 | 10/1997 | Guaraldi et al. | 101/415.1 |

FOREIGN PATENT DOCUMENTS

| | | |
|---|---|---|
| 62-169646 | 7/1987 | Japan . |
| 8-207250 | 8/1996 | Japan . |

*Primary Examiner*—Edgar Burr
*Assistant Examiner*—Leslie Grohusky
*Attorney, Agent, or Firm*—Merchant, Gould, Smith, Edell, Welter & Schmidt

[57] ABSTRACT

Shafts 7, a plate 6 and a guide plate 5 are moved so as to follow movement of both a stay 4 and a pushing member 3 by pushing force of coil springs 12 when the stay 4 and the pushing member 3 are moved toward a direction of an arrow 91 in accordance with rotation of pinion gears 15. The movement of both the plate 6 and the guide plate 5 is suspended when the shaft grips 7*b* are contacted to arms 13. Thereafter, only the stay 4 and the pushing part 3 are moved toward a direction of the arrow 91. So that, a tail edge side part 10*b* of the plate 10 is guided between the tail edge side clamp 23 and the tail side clamping base 24 along with the guide plate 5.

6 Claims, 16 Drawing Sheets

<The first prior art>

<The first prior art>

<The second prior art>
103
8
10
10b
68
67
65
66
2

<The second prior art>
104
8
10
10b
68
67
65
66
2

<The second prior art>
8
10
68
67
10b
66
2

DEVICE FOR INSERTING AN EDGE OF A PLATE FOR A PRINTING MACHINE

CROSS-REFERENCE TO RELATED APPLICATIONS

This application is based on Application No. Hei 9-3856 filed on Jan. 13, 1997 in Japan, the content of which is incorporated hereinto by reference.

BACKGROUND OF THE INVENTION

1. Field of the Invention

The present invention relates to a device for inserting an edge of a plate to a plate cylinder of a printing machine, more specifically, a device for mounting a plate onto a plate cylinder of a printing machine automatically by inserting the edge of the plate into the plate cylinder of the printing machine.

2. Description of the Prior Art

The First Prior Art

FIG. 15A and FIG. 15B show a device for inserting an edge of a plate for a printing machine (hereinafter referred to the first prior art) which have been conventionally used. A leading edge side clamp 21, a leading edge side clamping base 22, and a tail edge side clamp 23 and a tail side clamping base 24 are provided in a cut-out part 2H being formed in a plate cylinder 2 of the printing machine. A leading edge side part 10*a* of the plate 10 is clamped between the leading edge side clamp 21 and the leading edge side clamping base 22.

Upon clamping the leading edge side part 10*a* of the plate 10, the plate 10 is rolled around a cylinder surface of the plate cylinder 2 by rolling the plate cylinder 2 toward a direction of an arrow 100. The plate 10 is pressed to the cylinder surface of the plate cylinder 2 by a pressure roller 8.

As shown in FIG. 15A, a tail edge side part 10*b* of the plate 10 is located at a position that the tail edge side part 10*b* is contacted on a guide plate 62. The guide plate 62 is fixed to a rack board 61, and the rack board 61 can be moved toward a direction of an arrow 101 by sliding on a guide rail 60.

Both of the rack board 61 and the guide plate 62 are moved toward a direction of the arrow 101 from a condition shown in FIG. 15A (see FIG. 15B). The tail edge side part 10*b* of the plate 10 is guided between the tail edge side clamp 23 and the tail side clamping base 24 by movement of the guide plate 62 toward a direction of the arrow 101 as shown in FIG. 15B.

Thereafter, the pressure roller 8 is moved around the cylinder surface of the plate cylinder 2 in a direction of an arrow 105 (see FIG. 15B). So that, the tail edge side part 10*b* is completely inserted between the tail edge side clamp 23 and the tail side clamping base 24. The tail edge side part 10*b* is clamped between the tail edge side clamp 23 and the tail side clamping base 24 by closing the tail side clamping base 24. As a result, the tail edge side part 10*b* of the plate 10 is fixed between the tail edge side clamp 23 and the tail side clamping base 24 by inserting the tail edge side part 10*b* therebetween.

The Second Prior Art

Another inserting device being conventionally is shown in FIG. 16A, 16B and 16C (hereinafter referred to as the second prior art). In the inserting device of second prior art, the plate 10 is rolled around a cylinder surface of the plate cylinder 2, and the plate 10 is pressed to the cylinder surface of the plate cylinder 2 by the pressure roller 8. The tail edge side part 10*b* of the plate 10 is inserted into a slit 65 formed in the plate cylinder 2 in the inserting device of second prior art.

A plate feeder 67 moved reciprocally is provided on a lateral member 66, and a slider for insertion 68 is provide on a slanting part of the plate feeder 67. The lateral member 66 is usually positioned slightly apart from the plate cylinder 2. The lateral member 66 is moved toward a direction of an arrow 103 when the tail edge side part 10*b* is inserted into the slit 65. FIG. 16A shows a condition when the lateral member 66 is moved toward a direction of the arrow 103.

In the condition, the tail edge side part 10*b* is situated so as to contact with the lateral member 66. The plate feeder 67 is moved toward a direction of the arrow 103 on the lateral member 66 from the condition shown in FIG. 16A (see FIG. 16B). The tail edge side part 10*b* is moved along with the lateral member 66 so as to face the tail edge side part 10*b* with the slit 65 of the plate cylinder 2 by the movement of the plate feeder 67.

Thereafter, the slider 68 for insertion is moved on the slanting part of the plate feeder 67 toward a direction of an arrow 104 from a condition shown in FIG. 16B. FIG. 16C shows a condition that the slider 68 for insertion is moved down toward a direction of the arrow 104. As a result of moving the slider 68, the tail edge side part 10*b* is inserted into the slit 65 formed in the plate cylinder 2. Thus, the tail edge side part 10*b* can be inserted into the slit 65 formed in the plate cylinder 2.

However, the inserting devices of the first prior art and the second prior art described in the above have following problems to be resolved. In the inserting device of the first prior art, the tail edge side part 10*b* is guided between the tail edge side clamp 23 and the tail side clamping base 24 by movement of the guide plate 62 toward a direction of the arrow 101 in a condition that the tail edge side part 10*b* is contacted on the guide plate 62 (FIG. 15B). So that, the tail edge side part 10*b* can not be guided between the clamp 23 and the clamping base 24 when the edge of the tail edge side part 10*b* comes off from the guide plate 62.

On the contrary, in the inserting device of the second prior art, the tail edge side part 10*b* being .contacted with the lateral member 66 is pressed toward a direction of the arrow 103 along with the surface of the lateral member 66 by the movement of the plate feeder 67. Then, the tail edge side part 10*b* is inserted into the slit 65 by the movement of the slider 68 toward a direction of the arrow 104 along with the slanting part of the plate feeder 67.

Thus, the tail edge side part 10*b* is inserted into the slit 65 by the slider 68 in a condition that the tail edge side part 10*b* is guided on the lateral member 66 and the plate feeder 67. As a result, there is no probability to come off the edge of the tail edge side part 10*b* from the slider 68. Therefore, the problem stated in above does not occur in the other inserting device of the first prior art.

Although the inserting device of second prior art does not have the problem stated in above, timing for controlling the movement of the lateral member 66, the plate feeder 67 and the slider 68 must be adjusted respectively. So that, both a driving mechanism and a control mechanism of the lateral member 66, the plate feeder 67 and the slider 68 to be complicated.

OBJECTS AND SUMMARY OF THE INVENTION

It is an object of the present invention to provide a device for inserting an edge of a plate for a printing machine which capable of inserting the edge of the plate to the plate cylinder reliably by carrying out simple operation with simple structure.

In accordance with characteristic of the present invention, a device for inserting an edge of a plate to a holding part of a plate cylinder for a printing machine comprises:

a pushing part capable of being moved toward both an approach direction approaching the pushing part to the plate cylinder and a withdrawal direction withdrawing the pushing part from the plate cylinder, a driving force conveyance part for moving the pushing part toward both the approach direction and the withdrawal direction when driving force is conveyed therethrough, and movement of the pushing part being stopped when no driving force is conveyed therethrough, a guide part being positioned adjacent to the edge of the plate, the guide part capable of being moved both the approach direction and the withdrawal direction separately from the pushing part, a movement suspension part for suspending movement of the guide part when the guide part is reached at a guide position during the movement of the guide part toward the approach direction, a bias part for pushing the guide part toward the approach direction, wherein movement of the guide part toward the approach direction is suspended by receiving pushing force toward the approach direction generated by the bias part with the pushing part, and wherein the guide part is moved toward the approach direction so as to follow movement of the pushing part by receiving the pushing force of the bias part when the pushing part is moved toward the approach direction, and wherein movement of the guide part is suspended by the movement suspension part at the guide position during the movement of the pushing part toward the approach direction, and wherein the pushing part is further moved toward the approach direction even after the movement of the guide part is suspended at the guide position, and the edge of the plate being contacted to the guide part is guided to the clamping of the plate cylinder with the pushing part by pushing the edge along with the guide part.

Also, in accordance with characteristic of the present invention, a device for inserting an edge of a plate to a holding part of a plate cylinder for a printing machine comprises:

a pushing part capable of being moved toward both an approach direction approach the pushing part to the plate cylinder and a withdrawal direction withdrawing the pushing part from the plate cylinder, the pushing part being moved within a range between a start position and an end position, a rack provided to the pushing part, a pinion gear engaged with the rack, the pinion gear moving the pushing part toward both the approach direction and the withdrawal direction by rotation thereof when driving force is conveyed therethrough, and the movement of the pushing part being stopped when no driving force is conveyed therethrough, a movable guide part being positioned adjacent to an edge of the plate, the movable guide part capable of being moved both the approach direction and the withdrawal direction separately from the pushing part within a range between a start position and an end position, a restriction wall for suspending movement of the movable guide part when the movable guide part is reached at a guide position during the movement of the movable guide part toward the approach direction, a bias part for pushing the movable guide part toward the approach direction, and the movable guide part being contacted with the pushing part by pushing force of the bias part generated toward the approach direction, wherein the movable guide part is moved toward the approach direction from the start position so as to follow the movement of the pushing part by receiving the pushing force of the bias part under a condition that the movable guide part maintains contact with the pushing part when the pushing part is moved toward the approach direction from the start position by rotation of the pinion gear, and wherein the movement of the movable guide part is suspended by the restriction wall at the guide position, and wherein the pushing part is further moved toward the approach direction to the end position under a condition that the pushing part is moved apart from the movable guide part after the suspension of the movable guide part at the guide position, and the edge of the plate being contacted to the movable guide part is guided to the holding part of the plate cylinder with the pushing part by pushing the edge along with the movable guide part, and wherein the pushing part is moved toward the withdrawal direction to the start position so as to follow the movement of the movable guide part with the pushing part by pushing the movable guide part against the pushing force of the bias part with the pushing part, the pushing part is contacted to the movable guide part being suspended at the guide position during the movement of the pushing part toward the withdrawal direction when the pushing part Is moved toward the withdrawal direction from the end position by rotation of the pinion gear, and wherein the rotation of the pinion gear is suspended when both the pushing part and the movable guide part are reached to the start position.

While the novel features of the invention are set forth in a general fashion, both as to organization and content, it will be better understood and appreciated, along with other objections and features thereof, from the following detailed description taken in conjunction with the drawings.

DESCRIPTION OF THE PREFERRED EMBODIMENT

An embodiment of a device for inserting an edge of a plate for a printing machine in the present invention will be described with referring to figures.

Description of the Drawings

Figure 1:
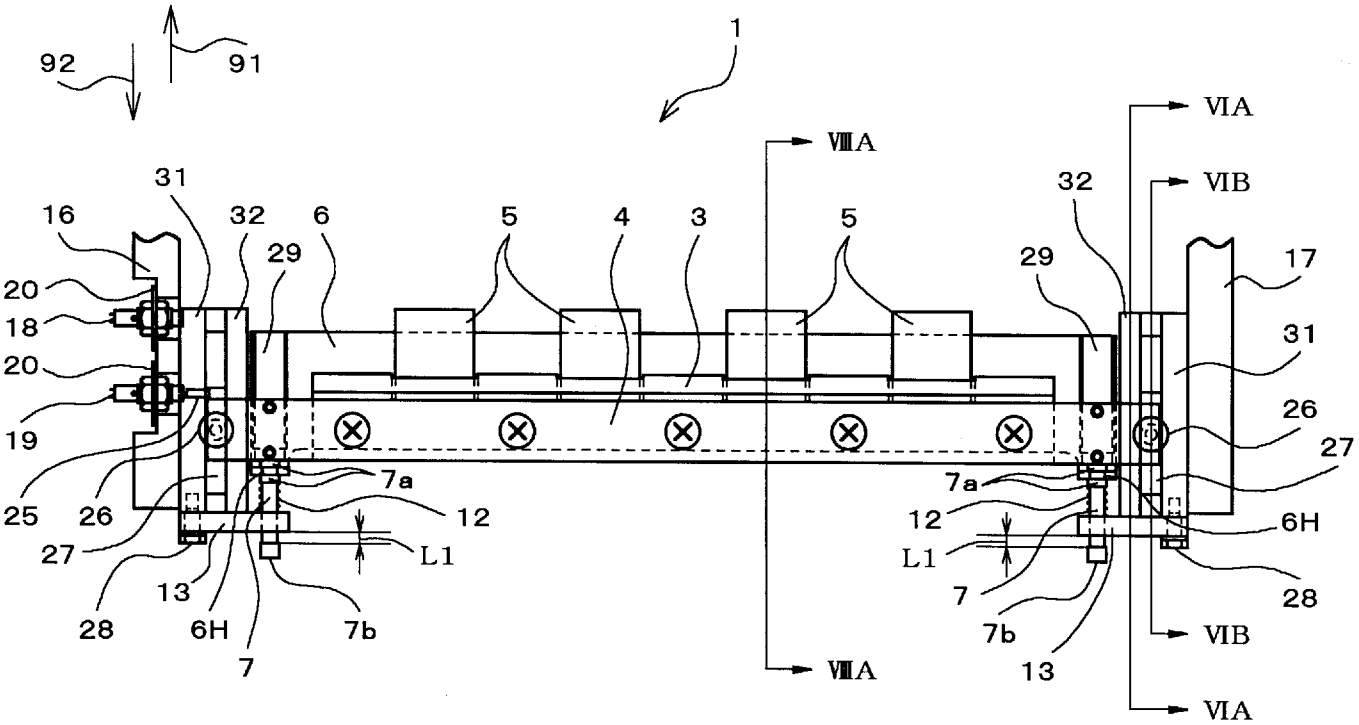
FIG. 1 is a plane view of a plate inserting unit 1 as an embodiment of an inserting device in the present invention.
Figure 2:
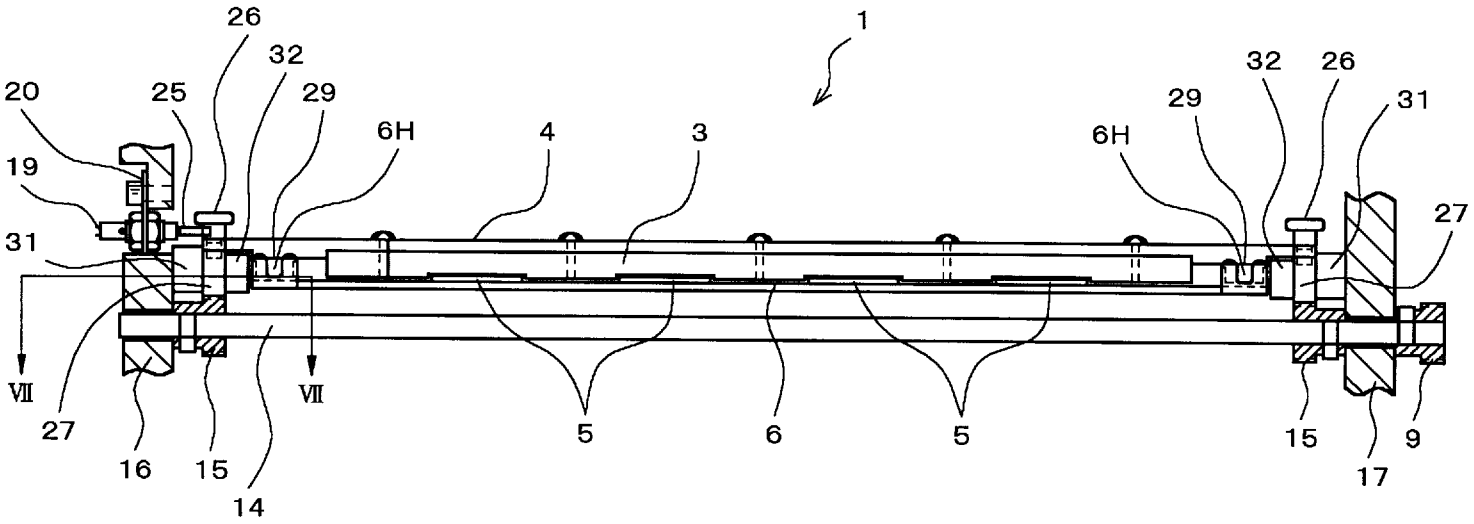
FIG. 2 is a front view showing the plate inserting unit 1 shown in FIG. 1.
Figure 3:
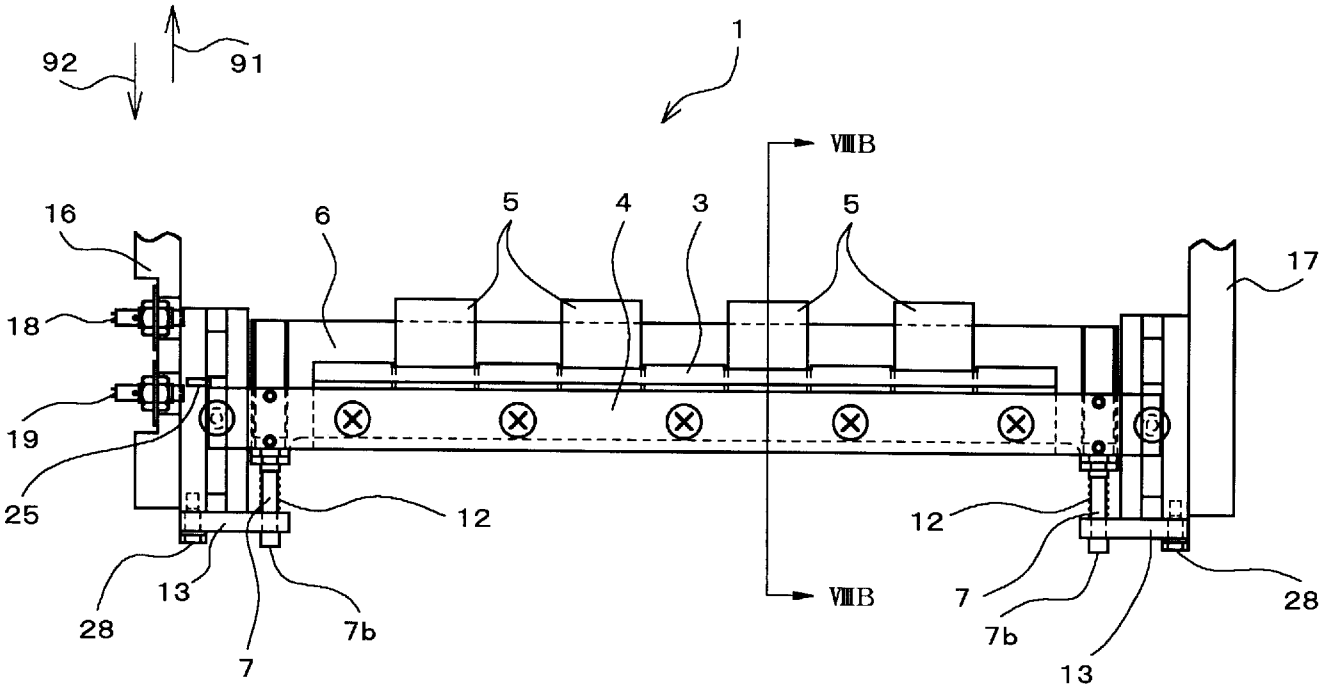
FIG. 3 is a plane view showing the plate inserting unit 1 which is under a condition that both a pushing member 3 and a stay 4 are moved toward a direction of an arrow 91 from the condition shown in FIG. 1.
Figure 4:
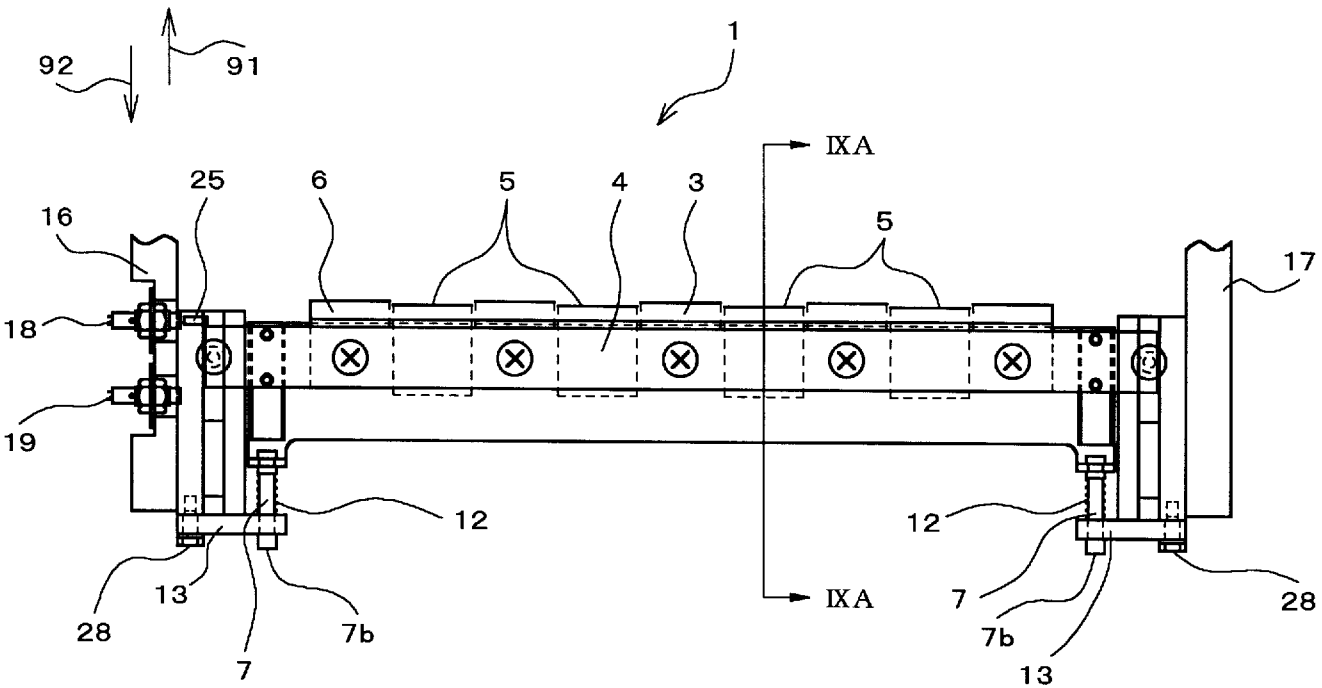
FIG. 4 is another plane view showing the plate inserting unit 1 which is under a condition that both a pushing member 3 and a stay 4 are moved further toward a direction of the arrow 91 from the condition shown in FIG. 3.

FIG. 1 is a plane view of a plate inserting unit 1 (the device for inserting an edge of a plate for a printing machine) in this embodiment, and FIG. 2 is a front view of the plate inserting unit. FIG. 3 is a plane view showing a condition that both a pushing member 3 and a stay 4 are moved toward a direction of an arrow 91 from the condition shown in FIG. 1. FIG. 4 is another plane view showing a condition that both a pushing member 3 and a stay 4 are moved further toward a direction of the arrow 91.

Figure 5:
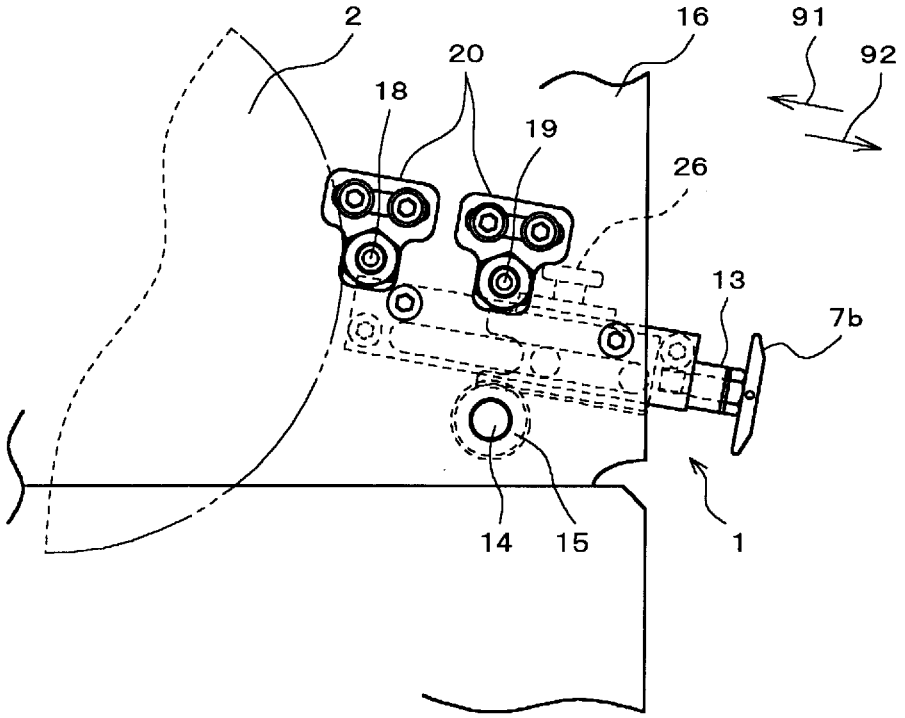
FIG. 5 is a side view showing a condition that the plate inserting unit 1 is provided to a frame 16.
Figure 6A:
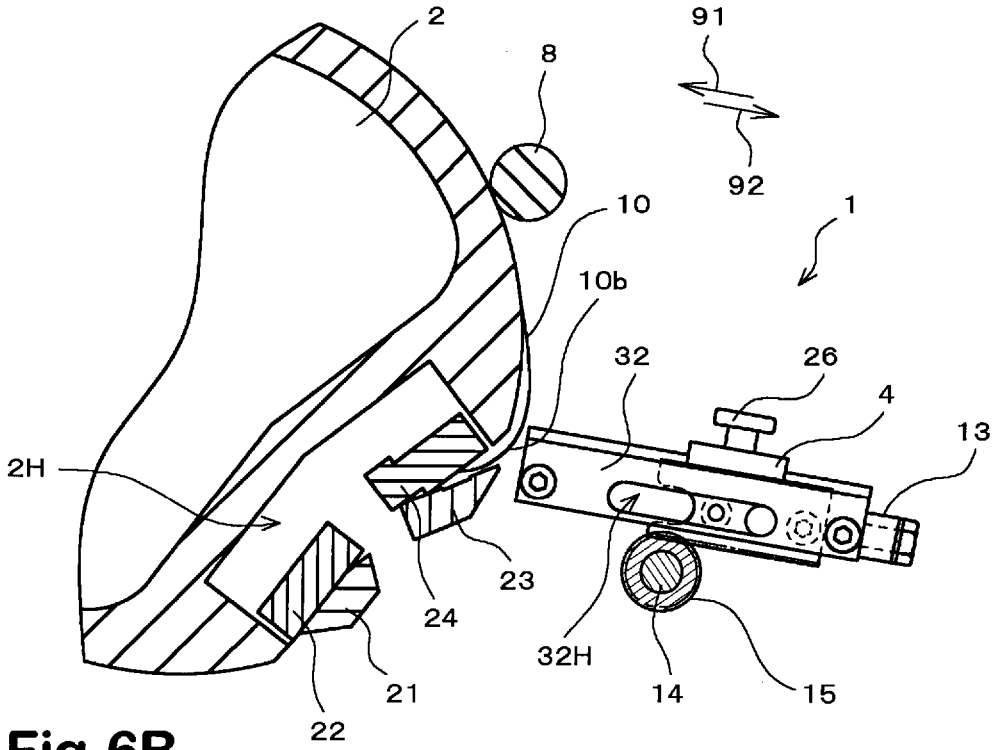
FIG. 6A is a cross sectional view in VIA—VIA direction of the unit shown in FIG. 1.
Figure 6B:
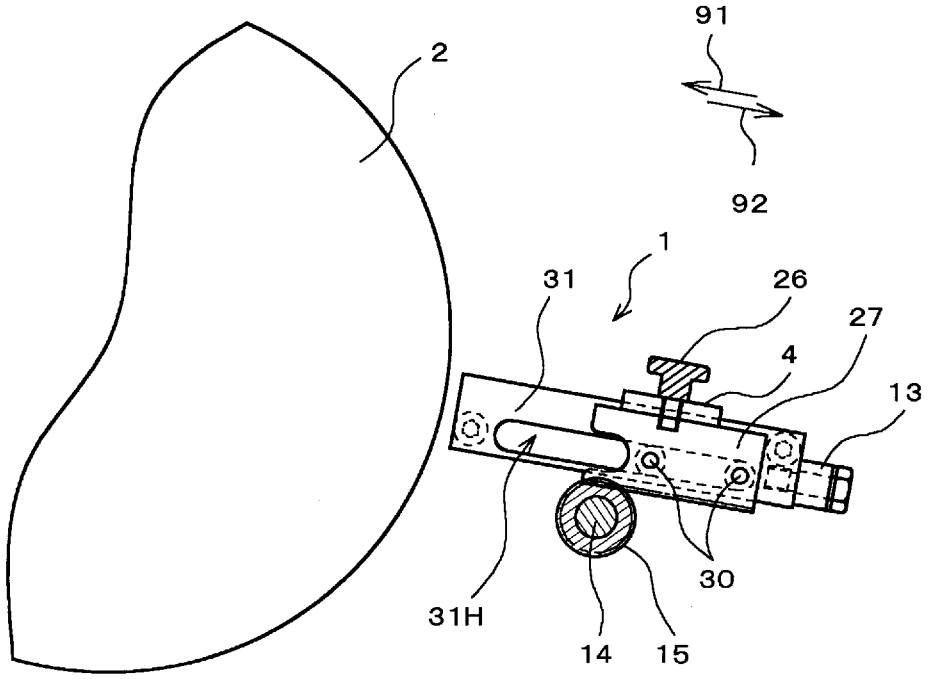
FIG. 6B is a cross sectional view in VIB—VIB direction of the unit shown in FIG. 1.
Figure 7:
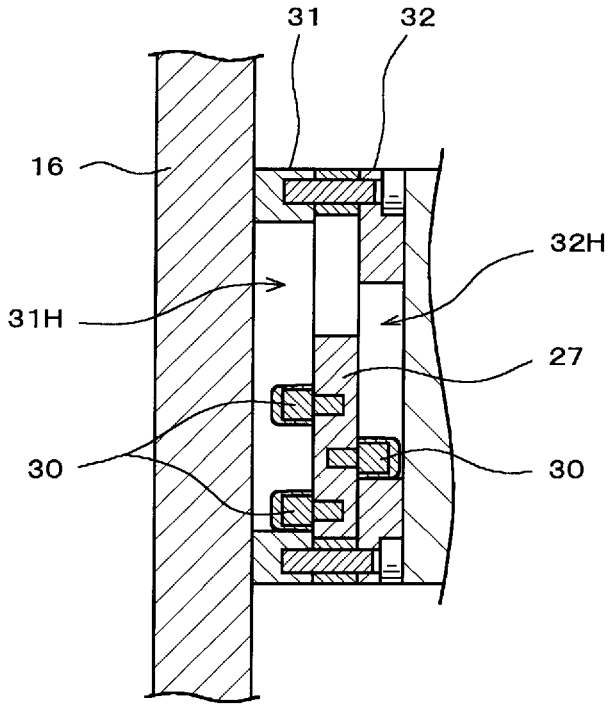
FIG. 7 is a cross sectional view in VII—VII direction of the unit shown in FIG. 2.
Figure 8A:
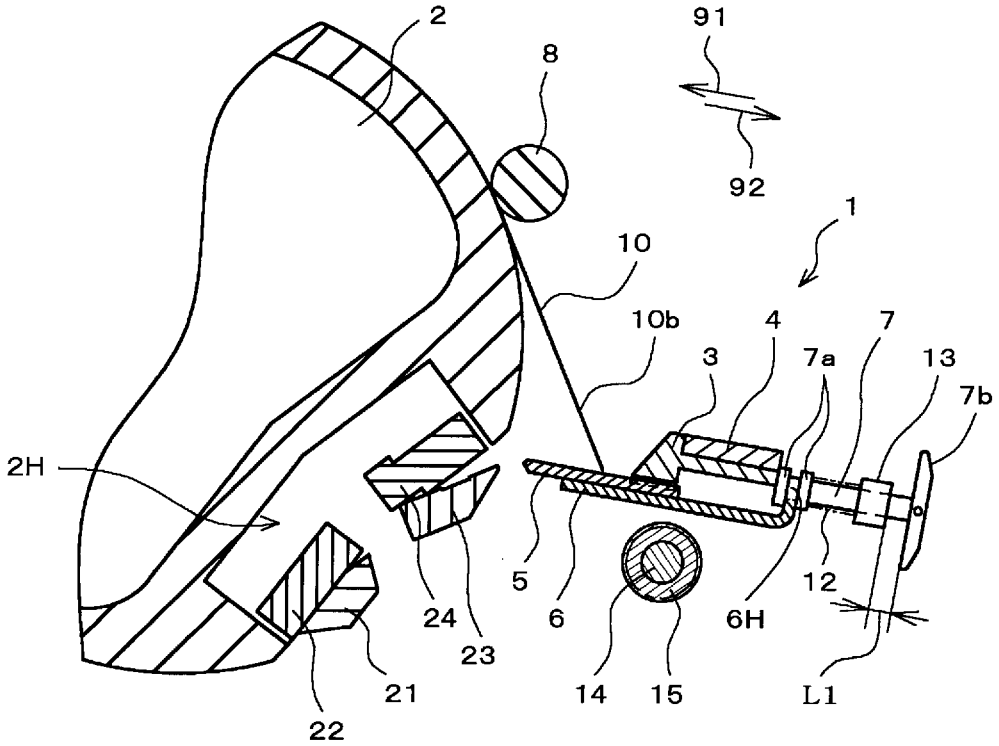
FIG. 8A is a cross sectional view in VIIIA—VIIIA direction of the unit shown in FIG. 1.
Figure 8B:
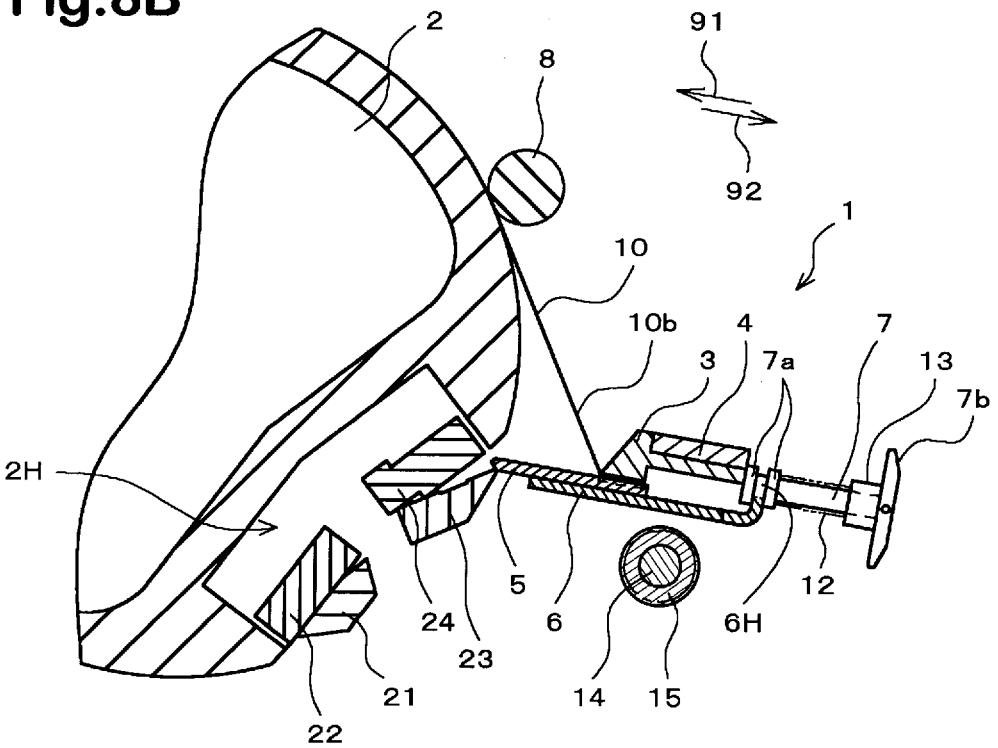
FIG. 8B is a cross sectional view in VIIIB—VIIIB direction of the unit shown in FIG. 3.

FIG. 5 is a side view showing a condition that the plate inserting unit 1 is provided to a frame 16 located on a side where operation of the unit is carried out (hereinafter referred to as first frame 16), and FIG. 6A is a cross sectional view in VIA—VIA direction of the unit shown in FIG. 1. FIG. 6B is another cross sectional view in VIB—VIB direction of the unit shown in FIG. 1. Also, FIG. 7 is a cross sectional view in VII—VII direction of the unit shown in FIG. 2, and FIG. 8A is a cross sectional view in VIIIA—VIIIA direction of the unit shown in FIG. 1. FIG. 8B is another cross sectional view in VIIIB—VIIIB direction of the unit shown in FIG. 3.

Figure 9A:
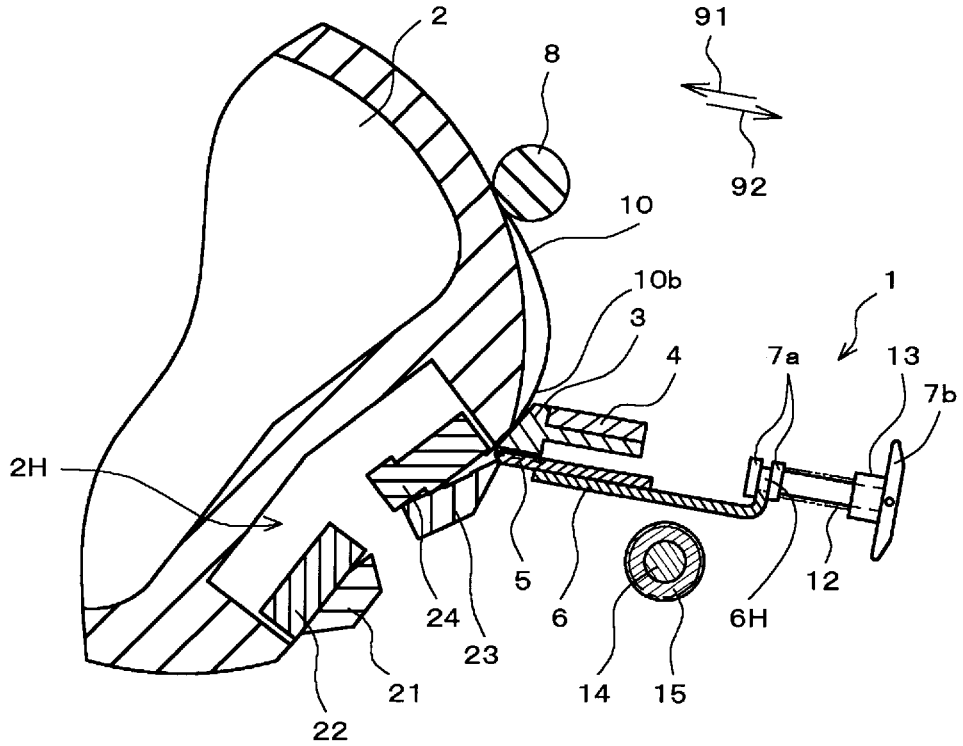
FIG. 9A is a cross sectional view in IXA—IXA direction of the unit shown in FIG. 4.
Figure 9B:
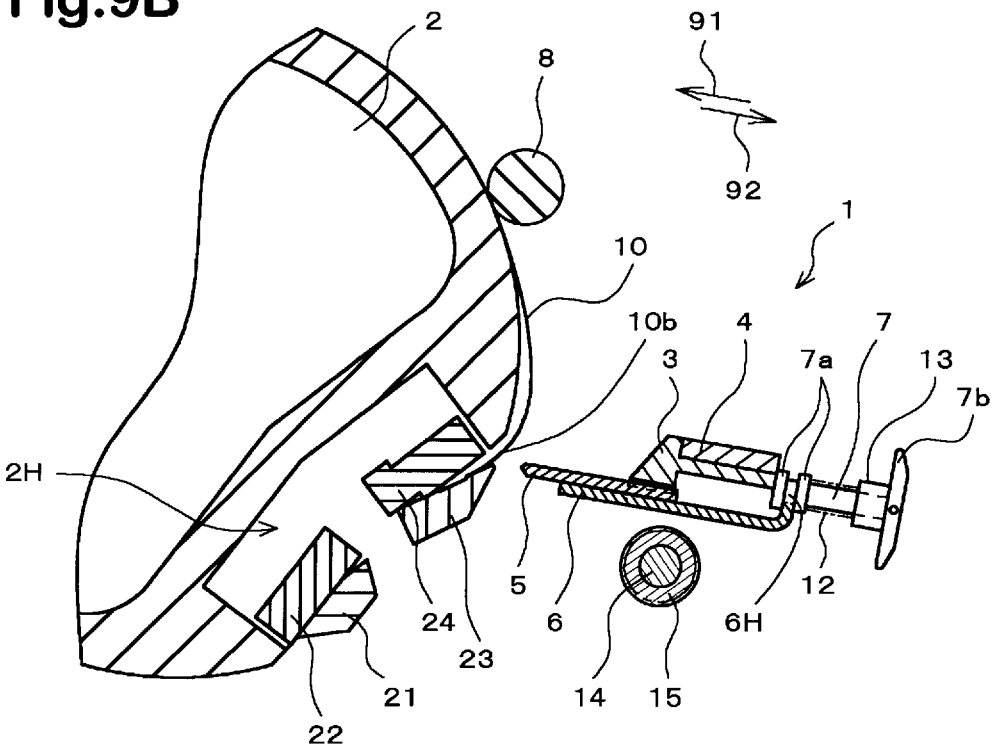
FIG. 9B is a cross sectional view showing the plate inserting unit which is under a condition that both the pushing member 3 and the stay 4 are moved toward a direction of an arrow 92 from the condition shown in FIG. 9A.

Further, FIG. 9A is a cross sectional view in IXA—IXA direction of the unit shown in FIG. 4, and FIG. 9B is another cross sectional view showing the unit which is under a condition that both the pushing member 3 and the stay 4 are moved toward a direction of an arrow 92 from the condition shown in FIG. 9A.

Figure 10:
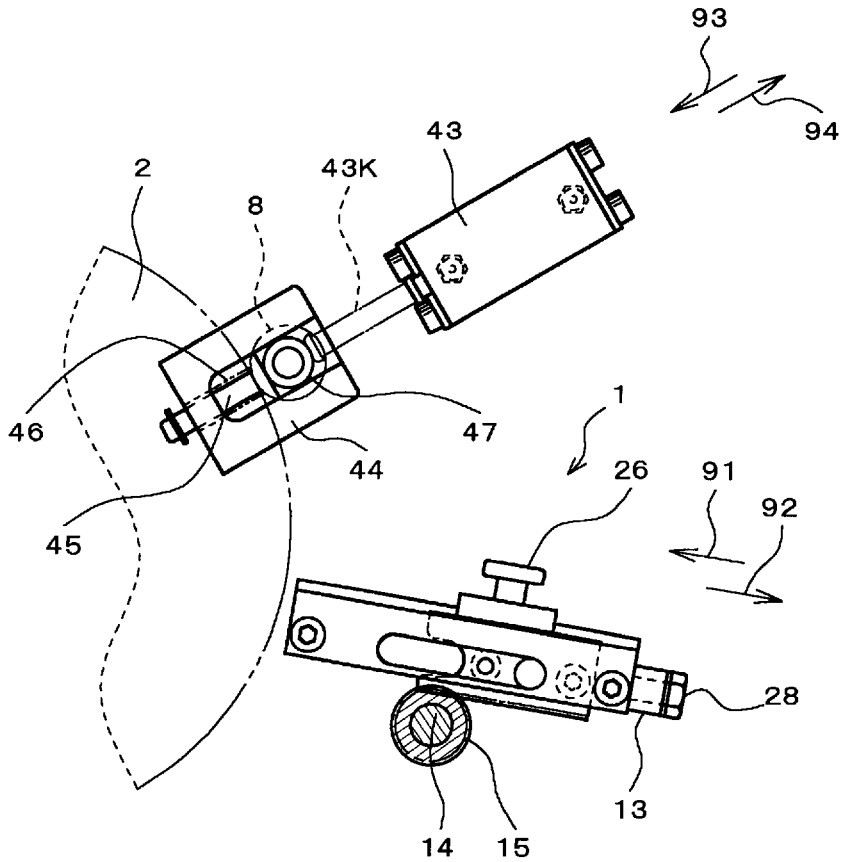
FIG. 10 is a side view showing a mechanism for moving a pressure roller 8 toward a direction of an arrow 93 and an arrow 94.
Figure 11:
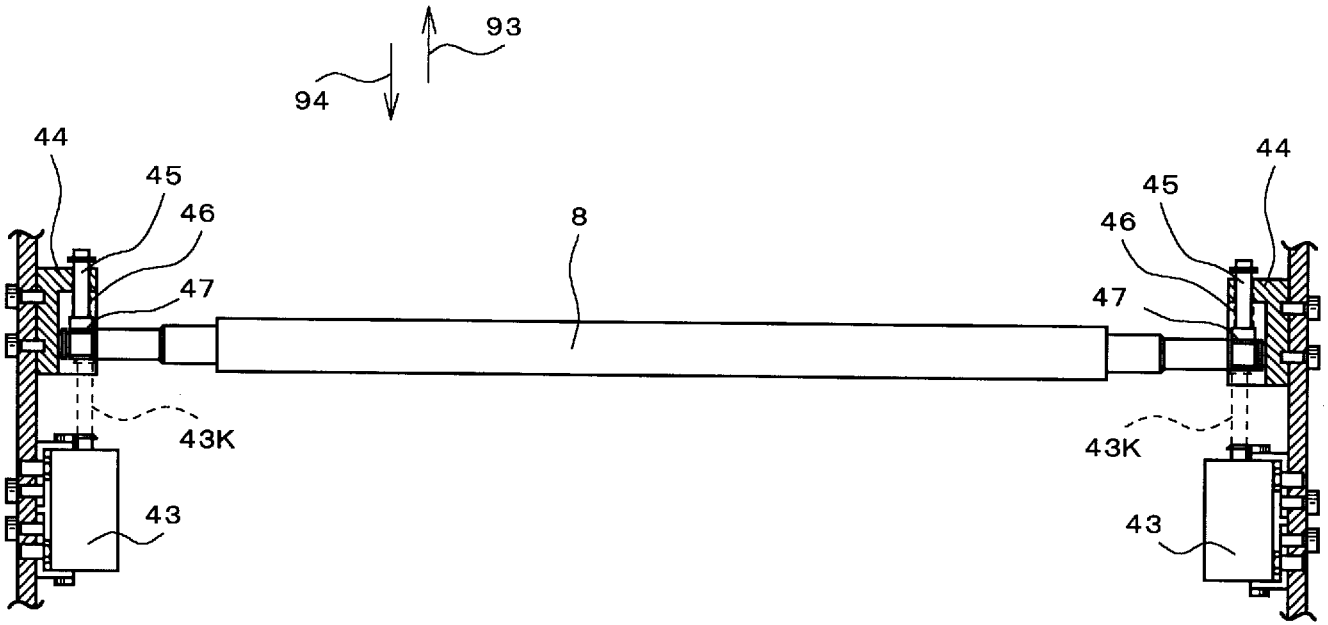
FIG. 11 is a plane view showing the mechanism shown in FIG. 10.
Figure 12:
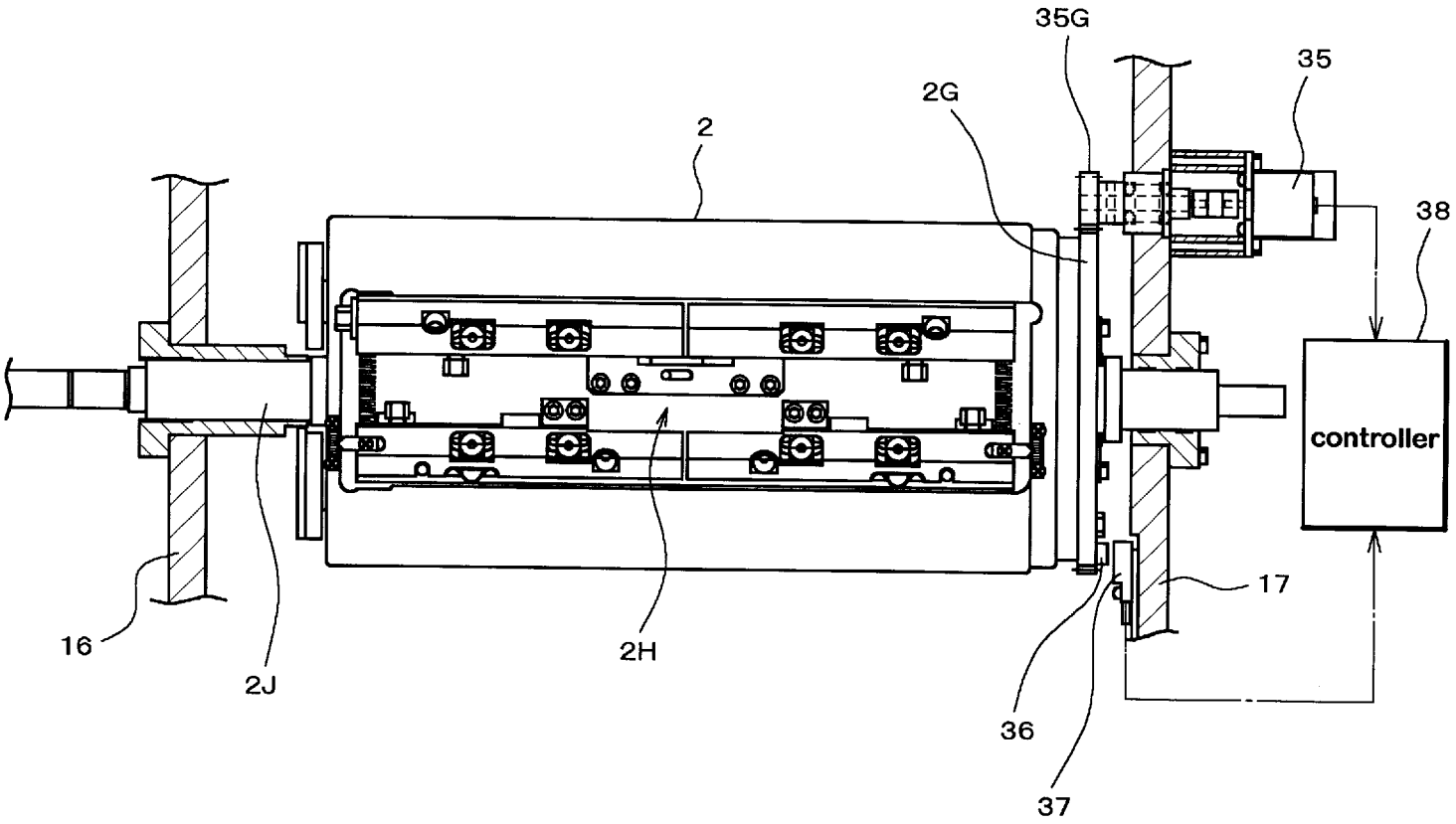
FIG. 12 is a plane view showing a plate cylinder 2.
Figure 13:
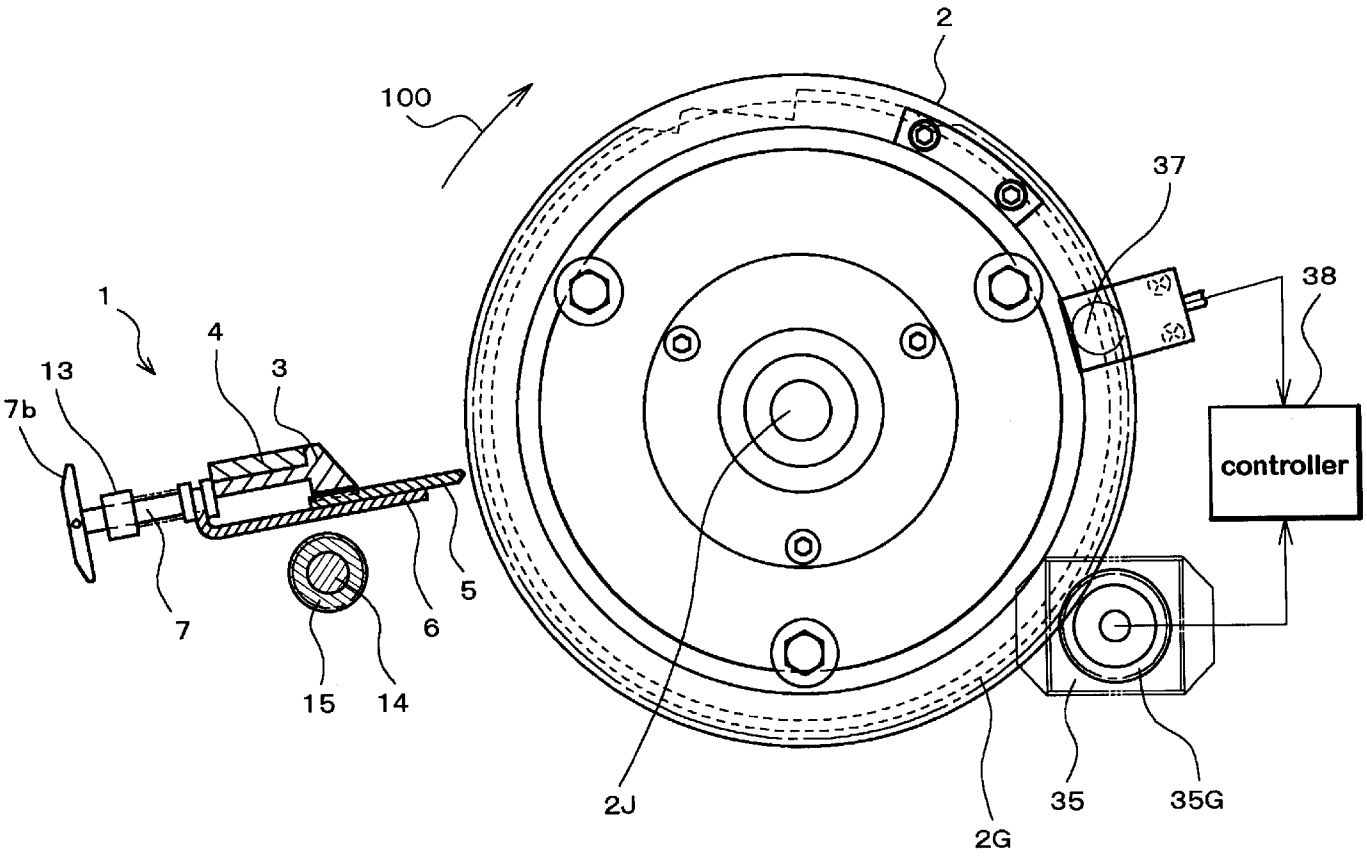
FIG. 13 is a side view of the plate cylinder 2 shown in FIG. 12.

FIG. 10 is a side view showing a mechanism for moving the pressure roller 8 toward a direction of an arrow 93 and an arrow 94, and FIG. 11 is a plane view showing the mechanism shown in FIG. 10. Also, FIG. 12 is a plane view showing a plate cylinder 2. FIG. 13 is a side view of the plate cylinder 2, and FIG. 14A and FIG. 14B are sectional side elevations for describing procedures to mount a plate 10 on the plate cylinder 2.

Overall structure

Figure 14A:
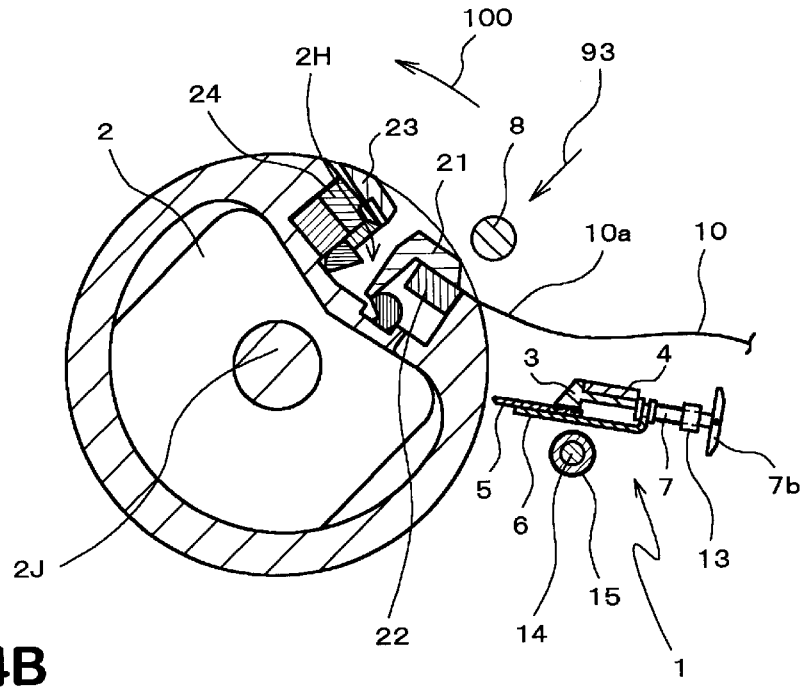
FIG. 14A is a sectional side elevation for describing a procedure to mount a plate 10 on the plate cylinder 2.
Figure 14B:
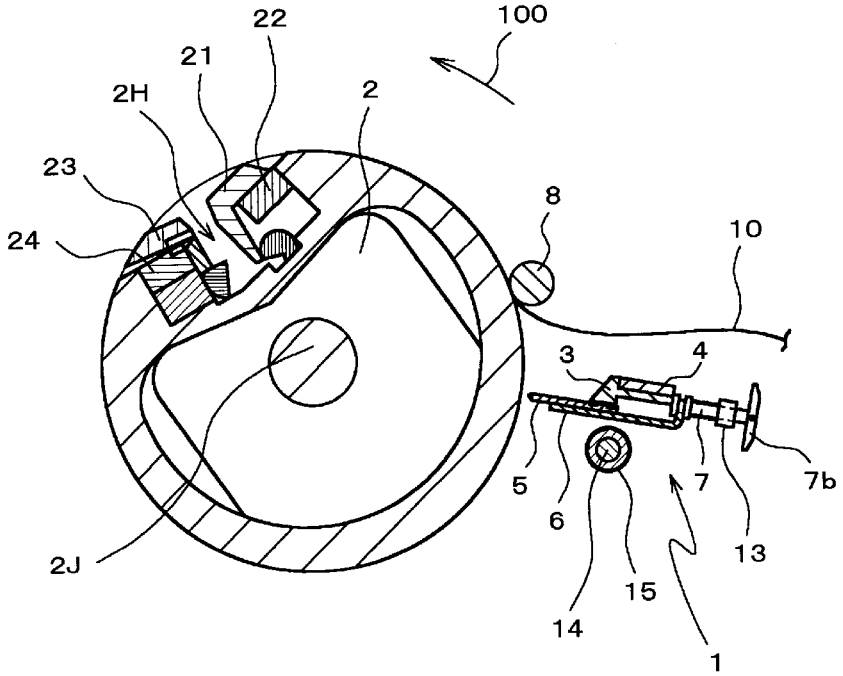
FIG. 14B is a sectional side elevation for describing a procedure to mount a plate 10 on the plate cylinder 2.
Figure 15A:
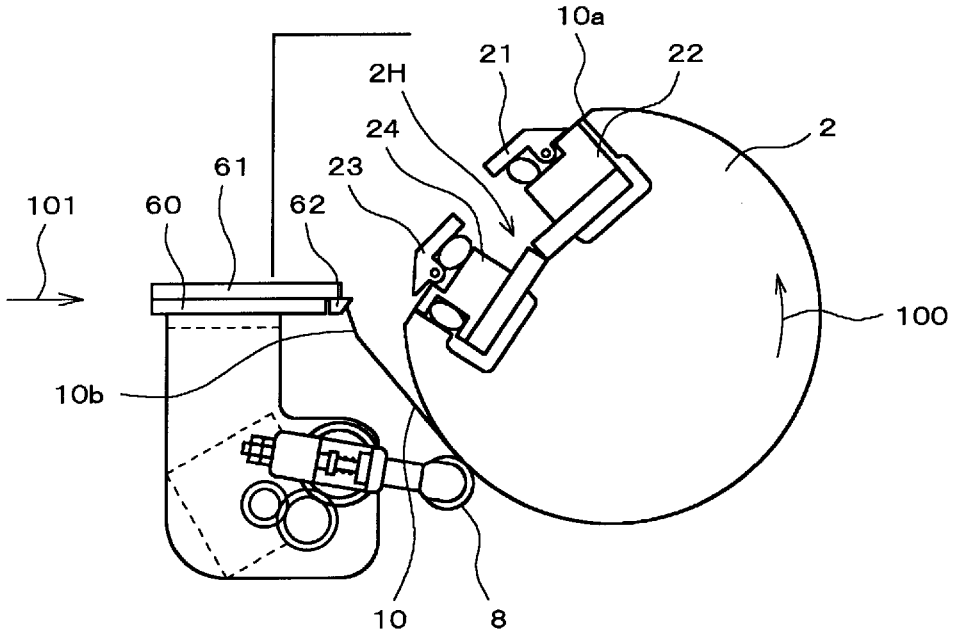
FIG. 15A is a side view showing a conventional inserting device of the first prior art used for a printing machine.
Figure 15B:
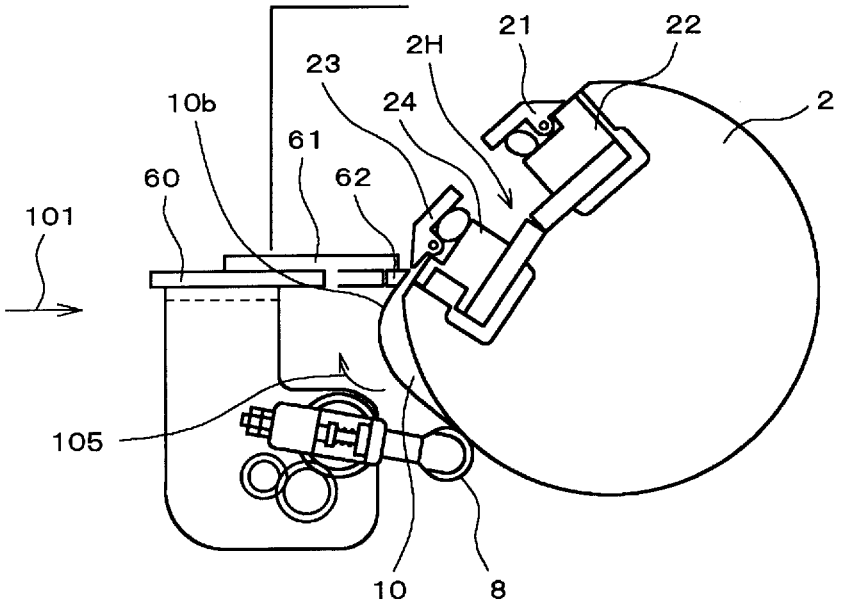
FIG. 15B is another side view showing a conventional inserting device used for a printing machine.
Figures 16A, 16B, 16C:
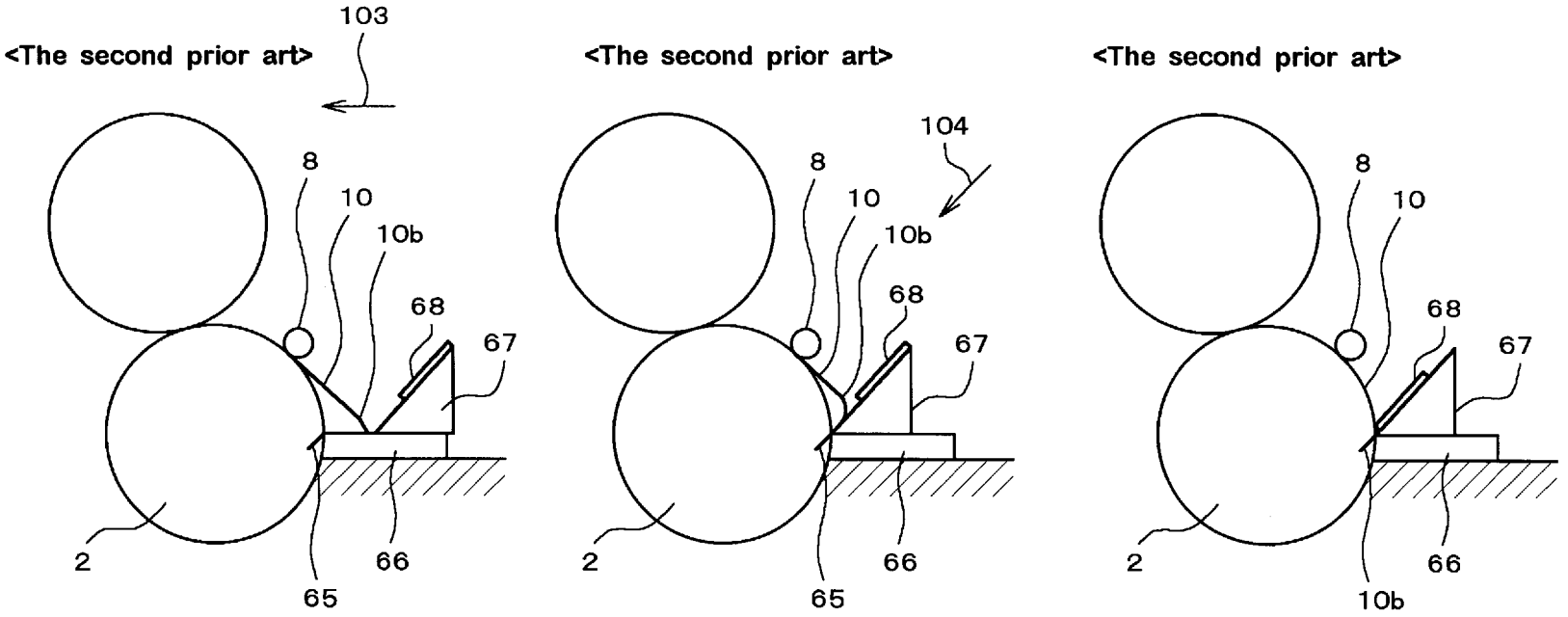
FIG. 16A is a side view showing the inserting device of the second prior art.
FIG. 16B is another side view showing the inserting device of the second prior art.
FIG. 16C is far another side view showing the inserting device of the second prior art.

A cut-out part 2H is formed in the plate cylinder 2 as shown in FIG. 14A and 14B, a leading edge side clamp 21, a leading edge side clamping base 22, a tail edge side clamp 23 and a tail edge side clamping base 24 are provided in the cut-out part 2H. The leading edge side clamp 21 can be opened and be closed to the leading edge side clamping base 22, a leading edge side part 10*a* of the plate 10 is clamped between the leading edge side clamp 21 and the leading edge side clamping base 22.

Upon clamping the leading edge side part 10*a* between the leading edge side clamp 21 and the leading edge side clamping base 22, the plate 10 is pressurized on a cylinder surface of the plate cylinder 2 by the pressure roller 8 which is moved toward a direction of the arrow 93. The plate 10 is rolled around the surface of the plate cylinder 2 by rotation of the plate cylinder 2, and the rotation of the plate cylinder 2 stops at a position shown in FIG. 8A.

The plate inserting unit 1 in this embodiment is provided at vicinity of the surface of the plate cylinder 2. A tail edge side part 10*b* of the plate 10 is inserted between the tail edge side clamp 23 and the tail edge side clamping base 24 (holding part) automatically by the plate inserting unit 1. An overall structure of the plate inserting unit 1 is described in hereunder.

The plate inserting unit 1 comprises the stay 4 and a plate 6 as shown in FIG. 1, FIG. 2 and FIG. 8A. The pushing member 3 is fixed to the stay 4, and a guide plate 5 is secured to the plate 6.

The stay 4 and the plate 6 are connected with each other through a pair of guide members 29. Both the stay 4 and the plate 6 can be moved toward directions of the arrow 91 and the arrow 92 along with the guide members 29 respectively. In other words, the plate 6 and the guide plate 5 can be moved respectively toward directions of the arrow 91 and the arrow 92 separate from both the stay 4 and the pushing member 3.

Also, the pushing member 3 is located on the guide plate 5 and is positioned thereby. Both the stay 4 and the pushing member 3 correspond to a pushing part in this embodiment. Also, both the plate 6 and the guide plate 5 correspond to a guide part in this embodiment, and the plate 6, the guide plate 5 and a shaft 7 are equivalent to a movable guide part. Further, a direction of the arrow 91 corresponds to an approach direction, and a direction of the arrow 92 is equivalent to a withdrawal direction.

As shown in FIG. 1 and FIG. 2, plates 31 and another plates 32 are provided to both the first frame 16 and a frame 17 located to opposite side of the first frame 16 (hereinafter referred to as second frame 17) respectively. Racks 27 are located in between the plates 31 and another plates 32. The plates 31, another plates 32 and the racks 27 are provided to the first frame 16 and the second frame 17 under symmetrical bases.

As shown in FIG. 7, two rollers 30 are provided to the outer side of the racks 27 and another roller 30 is disposed to the inner side thereof.

A slot 31H and another slot 32H are formed to the plates 31 and another plates 32 respectively. The two rollers 30 are engaged to the slot 31H, and another roller 30 is mated with the slot 32H. The racks 27 can be moved along with the slot 31H and another slot 32H in both directions of an arrow 91 and an arrow 92 respectively.

Pinion gears 15 are engaged with rack faces formed on the bottom of the racks 27. The pinion gears are fixed to a gear shaft 14 which is provided rotatably between the first frame 16 and the second frame 17 (see FIG. 2). Driving force generated by a motor for inserting a plate (not shown) is conveyed to a gear 9 which is disposed to one end of the gear shaft 14 and an outer side of the second frame 17.

In other words, the racks 27 are moved toward directions of the arrow 91 and the arrow 92 in accordance with rotation of the pinion gears 15 as a result of rotating of the gear shaft 14. Both ends of the stay 4 are connected to the racks 27 through a pair of knobs 26. Movement of both the stay 4 and the pushing member 3 toward the directions of the arrow 91 and the arrow 92 can be controlled by connecting the stay 4 to the racks 27.

Both of the gear shaft 14 and the pinion gears 15 correspond to a driving force conveyance part in this embodiment. The gear shaft 14 can not be rotated any further when no driving force is conveyed from the motor for inserting a plate. So that, the gear shaft 14 moves the pushing part when the driving force is conveyed therethrough, and the movement of the pushing part is stopped when no driving force is conveyed therethrough because each of the racks 27 engaged with the pinion gears 15, the stay 4 and the pushing member 3 can not be moved.

Detection sensors 18 and 19 (pushing part detection part) are disposed on the first frame 16 through brackets 20 as shown in FIG. 1 and FIG. 5. On the contrary, a pin 25 is provided to one of the racks 27, and the detection sensors 18 and 19 are disposed so as to detect movement of the pin 25 which is moved toward the directions of the arrow 91 and the arrow 92. Drive of the motor for inserting a plate is controlled by detecting the pin 25 with the detection sensors 18 and 19. As a result of the detection, movement of the racks 27 that is stay 4 and the pushing member 3 toward the directions of the arrow 91 and the arrow 92 is restricted within a certain range.

Also, arms 13 rotated by centering around fulcrum pins 28 which work as a fulcrum are provided to the plates 31. Shafts 7 are provided to free ends of the arms 13 so as to pass through the free ends and movably therethrough. A pair of convex parts 7*a* are provided to ends of the shafts 7. Coil springs 12 are disposed between the convex parts 7*a* and the arms 13.

The shafts 7 is pushed toward a direction of the arrow 91 by the coil springs 12.

Grooves formed between the convex parts 7*a* are coupled into "U" shaped grooves 6H formed on the plate 6 from an upper plane shown in FIG. 2. By forming the plate inserting unit 1 in this way, the plate 6 is moved together with the shafts 7 in accordance with movement of the shafts 7 toward the directions of the arrow 91 and the arrow 92. In this way, both the plate 6 and the guide plate 5 are pushed indirectly toward a direction of the arrow 91 by the coil springs 12 through the shafts 7. The coil springs 12 correspond to a bias part in this embodiment.

Forward ends of the shafts 7 keep facing with a rear surface of the stay 4. Movement of the shafts 7 toward a direction of the arrow 91 is restricted by facing the shafts 7 with the rear surface. As a result, movement of both the plate 6 and the guide plate 5 toward a direction of the arrow 91 is also restricted. A gap L1 shown in FIG. 1 and FIG. 8A is formed between the arms 13 and a shaft grips 7*b* which correspond to the other end of the shafts 7 by restricting the movement of the shafts 7 toward a direction of the arrow 91.

As shown in FIG. 10 and FIG. 11, the pressure roller 8 is positioned adjacent to the cylinder surface of the plate cylinder 2. Both ends of the pressure roller 8 are inserted into grooves formed on blocks 44, and ends of the pins 45 are contacted to the both ends of the pressure roller 8. The pins 45 are pushed toward a direction of the arrow 94 by spring coils 46 provided to the pins 45.

The pressure roller 8 is located at a position apart from the cylinder surface of the plate cylinder 2 by pushing force of the spring coils 46. A pair of air cylinders 43 are disposed to a place adjacent to both ends of the pressure roller 8. The pressure roller 8 is pressurized toward a direction of the arrow 93 as a result of moving rods 43K toward a direction of the arrow 93 when the air cylinders 43 are actuated. The pressure roller 8 is pushed to the cylinder surface of the plate cylinder 2 by the actuation of the air cylinders 43. So that, the pressure roller 8 is moved toward a direction of the arrow 93 which is opposite direction of the pushing force of the spring coils 46.

Further, a cylinder shaft 2J of the plate cylinder 2 is provided between the first frame 16 and the second frame 17 as shown in FIG. 12 and is rotated with a cylinder driving motor (not shown) which corresponds to a plate cylinder drive part. The cylinder driving motor is driven by control commands outputted by a controller 38. A gear 35G is engaged with another gear 2G installed to the plate cylinder 2. Rotation of the gear 35G is detected by an encoder 35 and is provided to the controller 38.

Also, a piece 36 for detection is fixed to a side of the plate cylinder 2, and a detection sensor 37 is disposed on the second frame 17. Position of the plate cylinder 2 in the rotating direction is recognized by the controller 38 in accordance with detection signals retrieved with the encoder 35 by using a position where the piece 36 for detection is detected with the detection sensor 37 as a reference position. The piece 36 for detection, the detection sensor 37 and the encoder 35 correspond to an insert position detection part in this embodiment.

Insert Operation of the Tail Edge Side Part 10*b*

Next, detail of operation for inserting the tail edge side part 10*b* of the plate 10 between the tail edge side clamp 23 and the tail side clamping base 24 is described herein. As described earlier, the leading edge side part 10*a* of the plate 10 is clamped between the leading edge side clamp 21 and the leading edge side clamping base 22 at the position shown in FIG. 14A.

Thereafter, as shown in FIG. 14B, the plate cylinder 2 is rotated in a direction of an arrow 100 with pressurizing the plate 10 to the cylinder surface of the plate cylinder 2 after moving the pressure roller 8 toward a direction of the arrow 93. In this way, the plate 10 is rolled around the cylinder surface of the plate cylinder 2. As described in above, the pressure roller 8 is moved toward a direction of the arrow 93 by actuation of the air cylinders 43 shown in FIG. 10 and FIG. 11.

Drive of the cylinder driving motor is suspended when rotation of the plate cylinder 2 toward a direction of the arrow 100 reaches to a position (insert position) shown in FIG. 8A. In other words, rotation of the plate cylinder 2 is suspended when a space formed between the tail edge side clamp 23 and the tail edge side clamping base 24 is opposed to an end of the guide plate 5. Drive of the cylinder driving motor is suspended by providing a command from the controller 38 (FIG. 12, FIG. 13).

As described earlier, the detection signals are provided to the controller 38 from the detection sensor 37 and the encoder 35 respectively. The controller 38 recognizes the position of the plate cylinder 2 in the rotating direction, and stops rotation of the plate cylinder 2 correctly at a position shown in FIG. 8A. The tail edge side part 10*b* of the plate 10 is moved so as to locate at a position on the guide plate 5 when rotation of the plate cylinder 2 is suspended (see FIG. 8A). The positions of the pushing member 3, the stay 4, the guide plate 5, the plate 6 and the shafts 7 shown in FIG. 8A are start positions of these parts in this embodiment.

The motor for inserting a plate initiates its operation when rotation of the plate cylinder 2 is suspended at the position shown in FIG. 8A. The driving force generated by the motor for inserting a plate is conveyed to the gear 9 disposed at one end of the gear shaft 14 (FIG. 2). Both the stay 4 and the pushing member 3 start moving toward a direction of the arrow 91 through the pinion gears 15 and the racks 27 as described in above when the gear shaft 14 is rotated by the motor for inserting a plate.

Here, the shafts 7 are pushed toward a direction of the arrow 91 by the coil springs 12 and movement of the shafts 7 toward the direction is restricted by facing the shafts 7 with the rear surface. So that, the shafts 7 are moved toward a direction of the arrow 91 simultaneous with the stay 4 by receiving the pushing force sprung back by the coil springs 12 when the stay 4 is moved toward a direction of the arrow 91. Both the plate 6 and the guide plate 5 are moved toward a direction of the arrow 91 so as to follow the movement of the stay 4 because the convex parts 7*a* of the shafts 7 are coupled into the "U" shaped grooves 6H.

FIG. 3 and FIG. 8B show a condition that the stay 4, the pushing member 3, the guide plate 5 and the plate 6 are moved toward a direction of the arrow 91 from the condition shown in FIG. 8A. The end of the guide plate 5 is moved to a position right beside the space formed between the tail edge side clamp 23 and the tail edge side clamping base 24. The positions of the guide plate 5, the plate 6 and the shafts 7 shown in FIG. 8B are guide positions of these parts in this embodiment.

The gap L1 formed between the arms 13 and the shaft grips 7*b* (FIG. 1, FIG. 8A) becomes gradually narrower when the shafts 7 are moved toward a direction of the arrow 91. The shaft grips 7*b* and the arms 13 contact with each other as a result of movement of the shafts 7 as shown in FIG. 3 and FIG. 8B. In this way, the shafts 7 can not be moved toward a direction of the arrow 91 any further. So that, the shafts 7 stop at the position shown in FIG. 8B. Therefore, both the guide plate 5 and the plate 6 stop at that position.

The shafts 7 for suspending the movement of the guide plate 5 at the position shown in FIG. 8A correspond to a movement suspension part or a penetration member in this embodiment. Also, the arms 13 correspond to a restriction wall, and the fulcrum pins 28 are equivalent to a central axis in this embodiment.

Both the pushing member 3 and the stay 4 are moved further toward a direction of the arrow 91 because the gear shaft 14 keeps its rotation (at that time, both the guide plate 5 and the plate 6 keep the positions shown in FIG. 8B). As described in above, the stay 4 and the plate 6 are connected with each other by the guide members 29, and both of which can be moved toward directions of the arrow 91 and the arrow 92 along with the guide members 29 respectively. In this way, the pushing member 3 is moved on the guide plate 5 toward a direction of the arrow 91, and the tail edge side part 10*b* of the plate 10 is pushed along with the guide plate 5 toward a direction of the arrow 91 with the end of the pushing member 3.

The motor for inserting a plate stops its operation when the pin 25 is detected by the detection sensor 18 shown in FIG. 1, and movement of the pushing member 3 toward a direction of the arrow 91 is suspended. The position of the pushing member 3 is shown in FIG. 4 and FIG. 9A. As shown in FIG. 9A, the end of the pushing member 3 is moved further toward a direction of the arrow 91 than the end of the guide plate 5.

Thus, the tail edge side part 10*b* of the plate 10 is guided and is inserted between the tail edge side clamp 23 and the tail edge side clamping base 24 reliably. Upon inserting the tail edge side part 10*b*, the tail edge side part 10*b* of the plate 10 is clamped by closing the tail edge side clamp 23 to the tail edge side clamping base 24. The positions of the pushing member 3 and the stay 4 shown in FIG. 9A are end positions of these parts in this embodiment.

The motor for inserting a plate starts a drive to an opposite direction after carrying out insertion of the tail edge side part 10*b* of the plate 10. To do that, both the pushing member 3 and the stay 4 are moved to the initial positions as a result of rotating the gear shaft 14 in the opposite direction. Then, the rear surface of the stay 4 reaches to a position contacting with the forward end of the shafts 7 as shown in FIG. 9B. Both the stay 4 and the pushing member 3 are moved further toward a direction of the arrow 92 continuously from the condition shown in FIG. 9B.

The shafts 7 are pushed toward a direction of the arrow 92 by the movement of the stay 4 and the pushing member 3, and the motor for inserting a plate stops its operation when the pin 25 provided to the racks 27 is detected by the detection sensor 19. FIG. 1 and FIG. 8A show a condition when the motor for inserting a plate stops its operation. As described earlier, the tail edge side part 10*b* of the plate 10 is guided and is inserted between the tail edge side clamp 23 and the tail edge side clamping base 24 automatically by using the plate inserting unit 1.

Removal Operation of the Plate Inserting Unit 1

The plate inserting unit 1 is removed from vicinity of the plate cylinder 2 in order to secure enough elbow room to carry out work efficiently when repair work or maintenance work of the plate cylinder 2 is done. In the case, at first, the knobs 26 are loosened so as to be both the stay 4 and the racks 27 independent with each other.

Thereafter, coupling maintained between the convex parts 7*a* and the "U" shaped grooves 6H is released by rotating the arms 13 shown in FIG. 1 to an upper direction by centering around the fulcrum pins 28. In order to carry out release operation, an operator of the printing machine rotates the arms 13 to the upper direction by centering around the fulcrum pins 28 with pulling the shaft grips 7*b* by fingers slightly in a direction of the arrow 92.

Hence, the coupling between the convex parts 7*a* and the "U" shaped grooves 6H is released. Thereafter, the pushing member 3, the stay 4, the guide plate 5 and the plate 6 being provided between the first frame 16 and the second frame 17 are removed as an unitized body. In this way, it is possible to secure enough elbow room for carrying out repair work or maintenance work.

The arms 13 and the shafts 7 both of which used for fixing the pushing member 3, the stay 4, the guide plate 5 and the plate 6 to the printing machine or used for detaching the fixture of those parts therefrom correspond to an attachment operating part in this embodiment.

Other Embodiments

The device for inserting an edge of a plate for a printing machine in the present invention is not limited to the embodiments described earlier, any other structure can be employed for realizing the characteristics of the invention. Although the pushing member 3 and the stay 4 are introduced as the pushing part in the preferred embodiment described earlier, other part(s) having different shape or structure from these parts may be employed as the pushing part as far as the part(s) can be moved toward both the approach direction and the withdrawal direction. The approach direction is a direction that the pushing part approaches to the plate cylinder 2, and the withdrawal direction is a direction that the pushing part withdraws from the plate cylinder 2.

Although, both the gear shaft 14 and the pinion gears 15 are used as the driving force conveyance part in the preferred embodiment, any other structure from these parts may be employed as the driving force conveyance part as far as the structure moves the pushing part toward both the approach direction and the withdrawal direction as well as the structure capable of moving the pushing part when the driving force is conveyed therethrough, and movement of the pushing part is stopped when no driving force is conveyed therethrough. For instance, the pushing part can also be moved with the driving force conveyance part having a chain belt which is engaged with a gear.

In addition, both the guide plate 5 and the plate 6 are introduced as the guide part, and the guide plate 5, the plate 6 and the shafts 7 are used as the movable guide part in the preferred embodiment. Other part(s) having different shape or structure from these parts may be employed as either of the guide part or the movable guide part as far as the part(s) can be moved toward both the approach direction and the withdrawal direction separately from the pushing part.

Although, the shafts 7 are introduced as the movement suspension part in the preferred embodiment, other structure or part(s) which stop the guide part at the guide position can be employed. For instance, stopper(s) which stops movement of both the guide plate 5 and the plate 6 may be provided somewhere on a track formed by movement of both the guide plate 5 and the plate 6.

In addition, the arms 13 are used as the restriction wall in the preferred embodiment, other part(s) having different shape or structure from the arms 13 may be employed as the restricting part as far as the part(s) capable of suspending the movable guide part at the guide position. The restriction wall is not limited to the structure being penetrated with the shafts 7. Although, the shafts 7 are introduced as the penetration member in the preferred embodiment, any other structure which can be released may also be employed as the penetration member.

Further, the coil springs 12 are used as the bias part in the preferred embodiment, other part(s) having different shape or structure from the coil springs 12 may be employed as the bias part as far as the part(s) capable of pushing the guide part toward the approach direction. For instance, plate springs can be used as the bias part for pushing the guide part. Also, magnet(s) can be used for the bias part to push the guide part under non-contact bases using magnetic force.

Still further, although the piece 36 for detection, the detection sensor 37 and the encoder 35 are introduced as the insert position detection part in the preferred embodiment, other part(s) having different shape or structure from these parts may be employed as the insert position detection part as far as the part(s) capable of detecting arrival of the holding part of the plate cylinder to the insert position. For instance, a limit switch or similar device can be used to detect the rotation of the plate cylinder to the insert position.

Although, the detection sensors 18 and 19 are used as the pushing part detection part in the preferred embodiment, any other structure from the detection sensors may be employed as the pushing part detection part as far as the structure capable of detecting the position of the pushing part. For instance, a limit switch or similar device can be used to detect the position of the pushing part.

Further, both the arms 13 and the shafts 7 are introduced as the attachment operating part, other part(s) having different shape or structure from these parts may be employed as the attachment operating part as far as the part(s) capable of fixing the pushing part and the guide part to the printing machine or releasing the fixture of those parts therefrom.

While the invention has been described in its preferred embodiments, it is to be understood that the words which have been used and words of description rather than limitation and that changes within the purview of the appended claims may be made without departing from the true scope and spirit of the invention in its broader aspects.

Advantages of the Present Invention

The device for inserting an edge of a plate for a printing machine in the present invention is characterized in that, both the pushing part and the guide part capable of being moved toward both an approach direction and a withdrawal direction. So that, both the pushing part and the guide part can be positioned at a position apart from the plate cylinder. Therefore, both the pushing part and the guide part can be positioned far from the plate cylinder. In this way, the pushing part and the guide part never bother mounting work of the plate and printing work.

Also, the edge of the plate is guided to the holding part of the plate cylinder with the pushing part along with the guide part. Therefore, it is possible to guide the edge of the plate with certain reliability.

Further, the guide part is moved toward the approach direction so as to follow movement of the pushing part by receiving the pushing force of the bias part when the pushing part is moved toward the approach direction, and movement of the guide part is suspended by the movement suspension part at the guide position during the movement of the guide part toward the approach direction. Then, the pushing part is further moved toward the approach direction even after the movement of the guide part is suspended at the guide position, and the edge of the plate being contacted to the guide part is guided to the holding part of the plate cylinder with the pushing part by pushing the edge along with the guide part.

In other words, the guide part is moved so as to follow the pushing part during the movement of the pushing part toward the approach direction, and the guide part is suspended at the guide position. So that, the guide part can be suspended at the guide position with simple structure even when the pushing part is moved toward the approach direction, and the edge of the plate is guided reliably to the holding part with the guide part along with the guide part.

Still further, the device for inserting an edge for a printing machine in the present invention is characterized in that, the device further comprises a pushing part detection part for detecting position of the pushing part. And the movement of the pushing part is controlled by the driving force conveyance part in accordance with detection of the pushing part detection part. So that, movement of the pushing part can be suspended accurately at predetermined positions in the approach direction and the withdrawal direction.

The device for inserting an edge of a plate for a printing machine in the present invention is characterized in that, the plate cylinder drive part suspends rotation of the plate cylinder when the insert position detection part detects arrival of the holding part to the insert position. And the edge of the plate is guided to the holding part of the plate cylinder with the pushing part after suspending the rotation of the plate cylinder. So that, rotation of the plate cylinder can be suspended at when the holding part of the plate cylinder is reached at the insert position. Therefore, the edge of the plate can reliably be guided to the holding part of the plate cylinder.

Still further, the device for inserting an edge of a plate for a printing machine in the present invention is characterized in that, at least both the pushing part and the guide part are formed as attachable parts to the printing machine, and an attachment operating part for attaching both of the pushing part and the guide part to the printing machine and for removing the pushing part and the guide part therefrom is comprised. So that, it is possible to remove both the pushing part and the guide part from the printing machine easily by releasing the fixture of the attachment operating part. Therefore, enough elbow room can be secured when maintenance work and repair work of the plate cylinder such as cleaning work are carried out as a result of removing the pushing-part and the guide part from the printing machine.

What is claimed is:

1. A device for inserting an edge of a plate to a holding part of a plate cylinder for a printing machine comprising:

a pushing part capable of being moved toward both an approach direction approaching the pushing part to the plate cylinder and a withdrawal direction withdrawing the pushing part from the plate cylinder, a driving force conveyance part for moving the pushing part toward both the approach direction and the withdrawal direction when driving force is conveyed therethrough, and movement of the pushing part being stopped when no driving force is conveyed therethrough, a guide part being positioned adjacent to the edge of the plate, the guide part capable of being moved in both the approach direction and the withdrawal direction separately from the pushing part, a movement suspension part for suspending movement of the guide part when the guide part is reached at a guide position during the movement of the guide part toward the approach direction, a bias part for pushing the guide part toward the approach direction, wherein movement of the guide part toward the approach direction is suspended by receiving pushing force toward the approach direction generated by the bias part with the pushing part, and wherein the guide part is moved toward the approach direction so as to follow movement of the pushing part by receiving the pushing force of the bias part when the pushing part is moved toward the approach direction, and wherein movement of the guide part is suspended by the movement suspension part at the guide position during the movement of the pushing part toward the approach direction, and wherein the pushing part is further moved toward the approach direction even after the movement of the guide part is suspended at the guide position, and the edge of the plate being contacted to the guide part is guided to the holding part of the plate cylinder with the pushing part by pushing the edge along with the guide part.

2. A device for inserting an edge of a plate to a holding part of a plate cylinder for a printing machine in accordance with claim 1, wherein the device further comprises a pushing part detection part for detecting a position of the pushing part, and wherein the movement of the pushing part is controlled by the driving force conveyance part in accordance with detection of the pushing part detection part.

3. A device for inserting an edge of a plate to a holding part of a plate cylinder in a printing machine in accordance with claim 1, wherein the device further comprising a plate cylinder drive part for rotating the plate cylinder and an insert position detection part for detecting arrival of the holding part of the plate cylinder to the insert position, and wherein the plate cylinder drive part suspends rotation of the plate cylinder when the insert position detection part detects arrival of the holding part to the insert position, and wherein the edge of the plate is guided into the holding part of the plate cylinder with the pushing part after suspending the rotation of the plate cylinder.

4. A device for inserting an edge of a plate to a holding part of a plate cylinder in a printing machine in accordance with claim 1, wherein at least both the pushing part and the guide part are formed as attachable parts to the printing machine, and wherein an attachment operating part for attaching both of the pushing part and the guide part to the printing machine and for detaching the pushing part and the guide part therefrom is comprised.

5. A device for inserting an edge of a plate to a holding part of a plate cylinder for a printing machine comprising:

a pushing part capable of being moved toward both an approach direction approaching the pushing part to the plate cylinder and a withdrawal direction withdrawing the pushing part from the plate cylinder, the pushing part being moved within a range between a start position and an end position, a rack provided to the pushing part, a pinion gear engaged with the rack, the pinion gear moving the pushing part toward both the approach direction and the withdrawal direction by rotation thereof when driving force is conveyed therethrough, and the movement of the pushing part being stopped when no driving force is conveyed therethrough, a movable guide part being positioned adjacent to an edge of the plate, the movable guide part capable of being moved in both the approach direction and the withdrawal direction separately from the pushing part within a range between a start position and an end position, a restriction wall for suspending movement of the movable guide part when the movable guide part is reached at a guide position during the movement of the movable guide part toward the approach direction, a bias part for pushing the movable guide part toward the approach direction, and the movable guide part being contacted with the pushing part by pushing force of the bias part generated toward the approach direction, wherein the movable guide part is moved toward the approach direction from the start position so as to follow the movement of the pushing part by receiving the pushing force of the bias part under a condition that the movable guide part maintains contact with the pushing part when the pushing part is moved toward the approach direction from the start position by rotation of the pinion gear, and wherein the movement of the movable guide part is suspended by the restriction wall at the guide position, and wherein the pushing part is further moved toward the approach direction to the end position under a condition that the pushing part is moved apart from the movable guide part after the suspension of the movable guide part at the guide position, and the edge of the plate being contacted to the movable guide part is guided to the holding part of the plate cylinder with the pushing part by pushing the edge along with the movable guide part, and wherein the pushing part is moved toward the withdrawal direction to the start position so as to follow the movement of the movable guide part with the pushing part by pushing the movable guide part against the pushing force of the bias part with the pushing part, the pushing part is contacted to the movable guide part being suspended at the guide position during the movement of the pushing part toward the withdrawal direction when the pushing part is moved toward the withdrawal direction from the end position by rotation of the pinion gear, and wherein the rotation of the pinion gear is suspended when both the pushing part and the movable guide part are reached to the start position.

6. A device for inserting an edge of a plate to a holding part of a plate cylinder in a printing machine in accordance with claim 5, wherein the movable guide part includes a guide part being positioned adjacent to the edge of the plate and a penetration member penetrating the restriction wall movably, and wherein coupling or releasing between the guide part and the penetration member can be done, and wherein at least the guide part is formed as an attachable part to the printing machine, and wherein the restriction wall can be rotated by centering around a central axis, and wherein the coupling and releasing the coupling between the guide part and the penetration member can be carried out by rotating the restriction wall.

* * * * *